US006231317B1

(12) United States Patent
Watanabe et al.

(10) Patent No.: US 6,231,317 B1
(45) Date of Patent: May 15, 2001

(54) SEALED COMPRESSOR DRIVEN BY A MOTOR

(75) Inventors: Kazutaka Watanabe; Yoshihiro Sasaki; Koichi Sekiguchi, all of Shimotsuga-gun (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/389,226

(22) Filed: Sep. 3, 1999

(30) Foreign Application Priority Data

Sep. 3, 1998 (JP) ..... 10-249294

(51) Int. Cl.[7] ..... F04B 17/00
(52) U.S. Cl. ..... 417/410.5; 418/55.1; 418/55.4
(58) Field of Search ..... 417/410.5; 418/55, 418/55.1, 55.4, 55.6

(56) References Cited

U.S. PATENT DOCUMENTS

| | | | | |
|---|---|---|---|---|
| 4,332,535 | * | 6/1982 | Terauchi et al. | 418/55 |
| 4,730,997 | * | 3/1988 | Tamura et al. | 418/55 |
| 4,755,114 | * | 7/1988 | Shibayashi et al. | 418/55 |
| 5,263,822 | * | 11/1993 | Fujio | 418/55.4 |
| 5,304,045 | | 4/1994 | Hoshino et al. . | |
| 5,456,584 | * | 10/1995 | Isomura et al. | 418/55.1 |
| 5,472,328 | * | 12/1995 | Saito et al. | 418/55.4 |
| 5,660,539 | * | 8/1997 | Matsunaga et al. | 418/55.6 |

FOREIGN PATENT DOCUMENTS

| | | |
|---|---|---|
| 58-160587 | 9/1983 | (JP) . |
| 63-21385 | 1/1988 | (JP) . |
| 2303337 | 12/1990 | (JP) . |
| 264886 | 12/1995 | (TW) . |

* cited by examiner

*Primary Examiner*—Charles G. Freay
*Assistant Examiner*—Ehud Gartenberg
(74) *Attorney, Agent, or Firm*—Antonelli, Terry, Stout & Kraus, LLP

(57) ABSTRACT

To resolve a problem of decreasing a heat exchange rate of a refrigerating cycle owing to a large amount of a refrigerator oil delivered from a discharge pipe to the refrigerating cycle, there is provided a sealed compressor driven by a motor having a compressor unit and a motor unit in which a ring is provided at an outer periphery of a coil end of a stator on a side of the compressor unit to reduce the amount of delivering the refrigerator oil to the refrigerating cycle and a shape of a balance weight of a rotor on the side of the compressor unit is formed in a cylindrical shape a portion of a side face of which is opened and an end face of which is flat to thereby reduce stirring of fluid.

13 Claims, 3 Drawing Sheets

SEALED COMPRESSOR DRIVEN BY A MOTOR

BACKGROUND OF THE INVENTION

1. Field of the Invention

The present invention relates to a sealed compressor driven by a motor used in a refrigerating machine or an air conditioning system.

2. Description of the Related Art

A conventional sealed compressor driven by a motor is provided with a compressor unit installed at an upper portion in a cylindrical drum which is a main body of a hermetically sealed vessel and a motor unit installed on the lower side of the compressor unit for driving the compressor unit. A refrigerant returned from a refrigerating cycle of a refrigerator, an air conditioner or the like is sucked from a refrigerant suction pipe installed at an upper portion of the cylindrical drum, compressed by the compressor unit and thereafter temporarily delivered from a refrigerant discharge port installed at a central portion of the compressor unit into the hermetically sealed vessel A portion of gas filled in the cylindrical drum reaches an upper portion of a rotor from a gap of a coil end present on the side of the compressor unit of a stator constituting the motor. Other portion of the gas reaches a lower portion of the motor after passing through a refrigerant gas passage installed at a steel plate portion of the outer configuration of the stator and thereafter flows into an upper space of the rotor after passing through a clearance between the stator and the rotor. Thereafter, the gas which has flowed into the upper space of the rotor is delivered from a discharge pipe installed to project inwardly from an inner wall of the cylindrical drum to the refrigerating cycle.

At this occasion, the gas which has flowed from the gap of the coil end on the compressor unit side of the stator into the upper space of the rotor is a mist-like gas including a large amount of refrigerator oil since it is the gas immediately after having been delivered from the compressor unit and it is constituted that the mist-like refrigerant gas including a large amount of the refrigerator oil is delivered to the refrigerating cycle via the discharge pipe while being stirred by an upper portion of the rotor.

Further, JP-A-63-21385 discloses a sealed compressor driven by a motor which reduces a refrigerator oil delivered to a refrigerating cycle A refrigerant delivered from an upper portion of a scroll compressor passes from an upper portion of a compressor unit through a refrigerant passage installed between the compressor unit and a hermetically sealed vessel, passes through a flow guideplate installed between a block provided with a main bearing for receiving thrust load of a orbital scroll and a stator of a motor and is guided from the compressor unit to a lower portion of the stator. In the procedure, an oil separator is installed between the cylindrical drum and the stator and therefore, the refrigerant which has passed through the oil separator is separated of refrigerator oil and the refrigerator oil is returned to an oil storage at a lower portion of the hermetically sealed vessel. In the meantime, the refrigerant separated of the refrigerator oil passes through a second oil separator installed between the cylindrical drum and the stator, is guided to a lower portion of the block while being separated of oil and is delivered to the refrigerating cycle from a discharge pipe installed between the block of the cylindrical drum and the stator.

According to the flow path of the refrigerant in the conventional sealed compressor driven by a motor, there pose following problems, explained below. Generally, inside of a sealed compressor driven by a motor is filled with a lubricant (refrigerator oil) in order to promote sliding efficiency and preventing wear of parts by reducing frictional force between parts at a compressor unit and a bearing portion.

Almost all of the refrigerator oil is stored at a bottom portion of inside of a hermetically sealed vessel, particularly, an oil storage portion, passes through an oil feed path installed in a shaft a lower portion of which is dipped in the oil storage portion and lubricates a main bearing portion, an intermediary between a orbital scroll and a fixed scroll in the compressor unit and an intermediary between a front end of a scroll lap and a endplate. The refrigerator oil which has passed through the oil feed path in the shaft and fed to the bearing portion, passes through a bearing clearance portion and is again stored at the bottom portion of the vessel.

In the meantime, the refrigerator oil fed to the compressor unit is delivered from a discharge port into the vessel similar to the refrigerant and again stored at the bottom portion of the vessel. However, a portion of the refrigerator oil delivered from the discharge port, is delivered in a mist-like form and therefore, almost all of the mist-like refrigerant oil passes through a passage similar to the above-described flow path of the refrigerant, discharged from the discharge pipe into the refrigerating cycle along with the refrigerant, passes again through a suction pipe and is returned to the compressor unit of the hermetically sealed vessel.

When an amount of the refrigerator oil which is carried over to the cycle in this way, is increased, there pose problems of a reduction in a heat exchange rate at a heat exchanger, insufficient feeding of oil to the bearing portion, the compressor unit or the like, and so on.

Further, according to the structure disclosed in JP-A-63-21385, mentioned above, the refrigerant delivered from the discharge port passes through single ones of a through hole installed in the compressor unit, the flow guide plate and the oil separator, reaches the oil storage portion installed at the lower portion of the hermetically sealed vessel, passes through the second oil separator therefrom and reaches a space between the block and the stator. Further, the refrigerant is constituted to flow out from the space into the refrigerating cycle via the discharge pipe.

In this way, according to the conventional technology, there poses a problem in which since the passage for passing the refrigerant in the hermetically sealed vessel is restricted, pressure loss is increased and when the structure is used as a compressor for a refrigerating cycle, the efficiency of the refrigerating cycle is lowered.

SUMMARY OF THE INVENTION

It is an object of the present invention to provide a compressor reducing flowing of a refrigerator oil out from a discharge pipe while restraining pressure loss.

It is other object of the present invention to provide a compressor having a balance weight reducing stirring of fluid in a hermetically sealed vessel.

In order to achieve the above-described object, there is provided a sealed compressor driven by a motor, wherein a compressor unit and a motor unit for driving the compressor unit are contained in a hermetically sealed vessel, a refrigerant from the compressor unit is delivered into the hermetically sealed vessel and delivered to the outside of the hermetically sealed vessel from a discharge pipe inserted into the hermetically sealed vessel and installed between the compressor unit and the motor unit, a member for reducing a gap of a coil end of a stator of the motor unit on a side of the compressor unit is provided and the discharge pipe is inserted inward from an outer periphery of the coil end.

Further, in order to achieve the above-described other object, there is provided a sealed compressor driven by a motor comprising a compressor unit and a motor unit for driving the compressor unit both contained in a hermetically sealed vessel, further comprising a balance weight installed at an end portion of a rotor of the motor unit on a side of the compressor unit, installed with a notch at a portion of an outer periphery thereof and including a space at an inner portion thereof.

BRIEF DESCRIPTION OF THE DRAWINGS

FIG. 3(*b*) is a perspective view of a rotor according to an embodiment of the present invention.

DETAILED DESCRIPTION OF THE PREFERRED EMBODIMENTS

Figure 1:
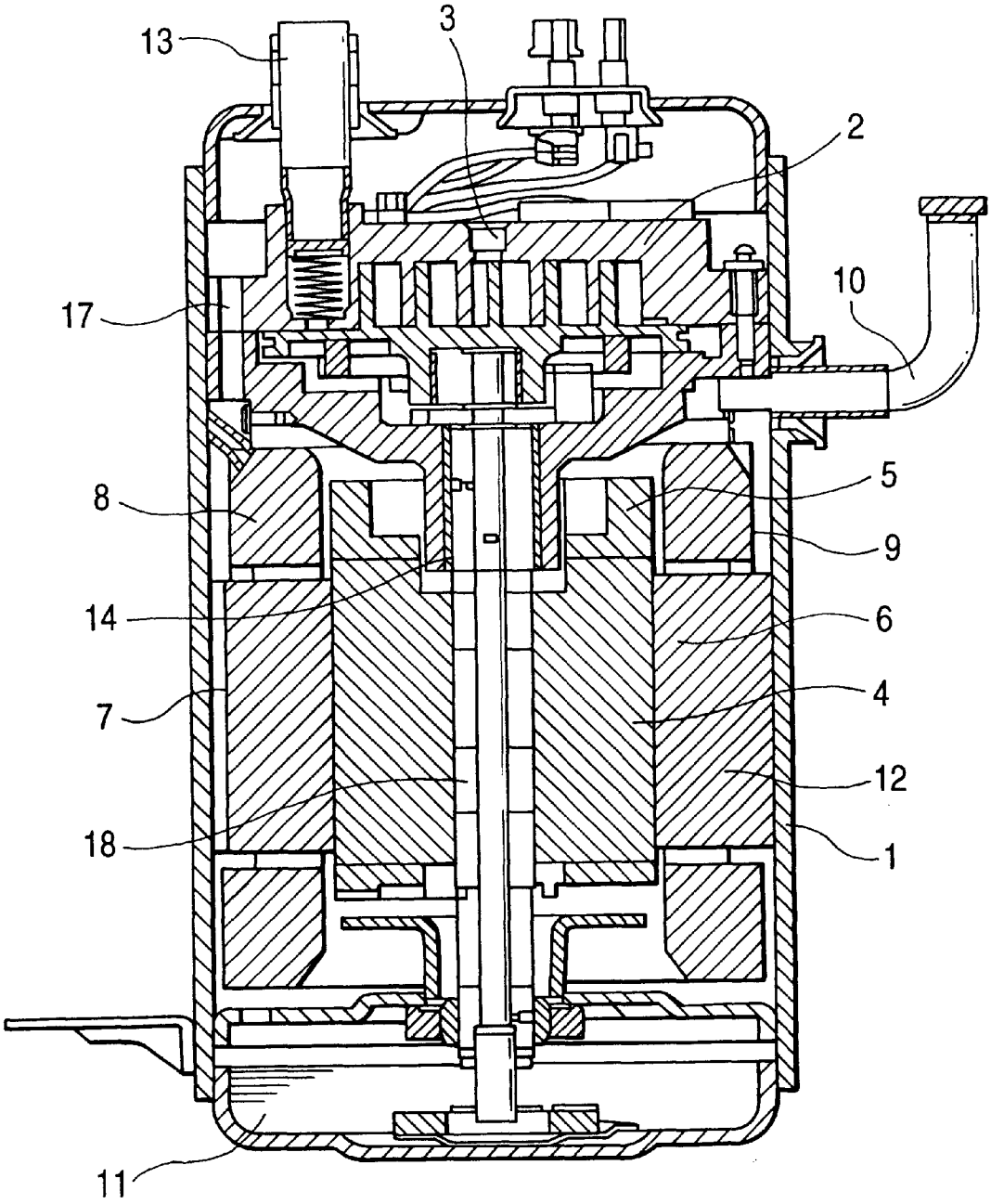
FIG. 1 is a view of a structure of a sealed compressor driven by a motor according to the present invention.
Figure 2:
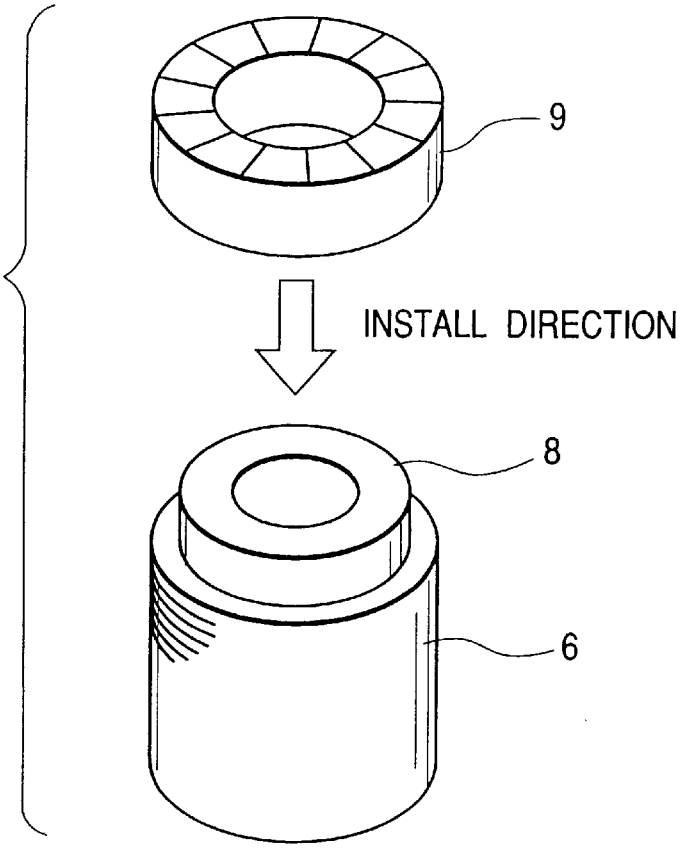
FIG. 2 is a perspective view for explaining attachment of a ring to a stator according to an embodiment of the present invention.
Figure 3A:
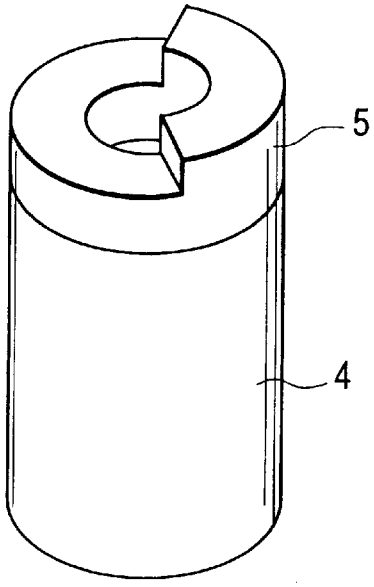
FIG. 3(*a*) is a perspective view of a rotor according to a conventional example.
Figure 3B:
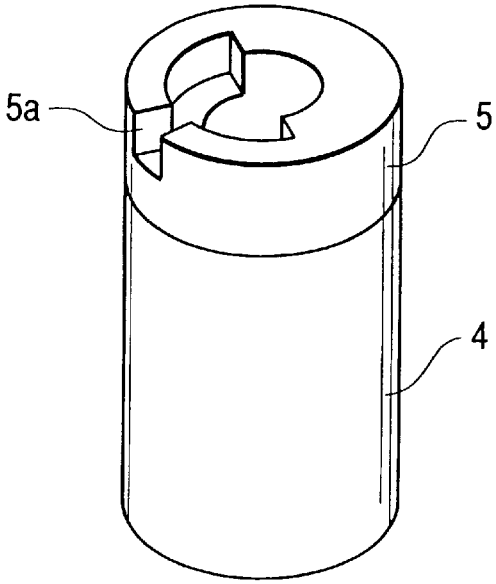
Figure 4:
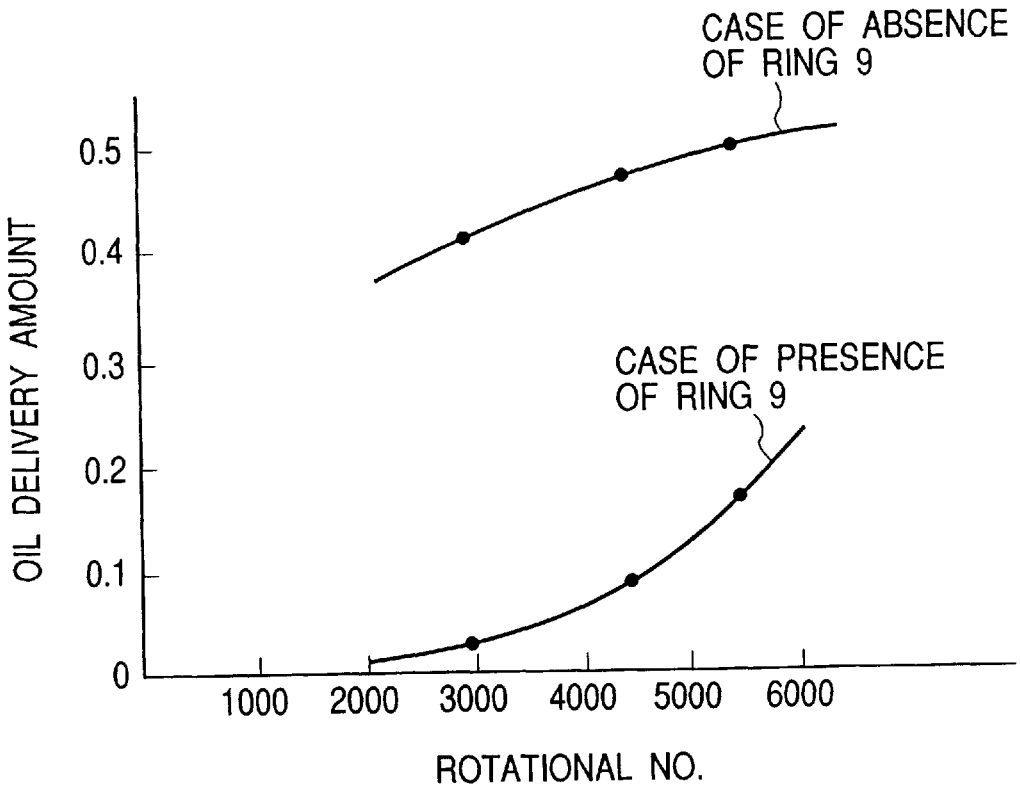
FIG. 4 is a diagram showing a characteristic of a sealed compressor driven by a motor according to the invention for explaining an effect of reducing an oil delivery amount.

In the followings, FIG. 1 shows a constitution of a sealed compressor driven by a motor according to the present invention and FIG. 2 and FIG. 3(*b*) show constitutions of respective portions thereof. Further, FIG. 4 shows an effect of reducing an oil delivery amount according to the embodiment.

In FIG. 1, a compressor unit 2 is installed in an upper portion of a cylindrical drum 1 which is the main body of a hermetically sealed vessel and a motor unit 12 for driving the compressor unit 2 is installed on the lower side of the compressor unit 2. The compressor unit 2 is constituted by a scroll compressor of a type in which a fixed scroll erected with a scroll lap on an end plate and a orbital scroll are in mesh with each other at a orbital position and by swirling the orbital scroll, a refrigerant sucked from a surrounding thereof, is compressed by reducing a volume of an operating chamber and is delivered from a discharge port 3 provided at a central portion thereof. The refrigerant sucked from a refrigerant suction pipe 13 inserted through a top portion of the hermetically sealed vessel and bonded to the compressor unit 2, is compressed by the compressor unit 2 and thereafter temporarily delivered from the refrigerant discharge port 3 installed at the central portion of the compressor unit 2 into an upper portion of the cylindrical drum 1. The gas refrigerant filled in the upper portion of the cylindrical drum 1 flows to the side of the motor unit 12 via through holes 17 opened at a plurality of portions of the surrounding of the compressor unit 2. A discharge pipe 10 is installed between the compressor unit 2 and the motor unit 12 and an opening portion of the discharge pipe 10 on the inner side of the hermetically sealed vessel is installed as proximate to the rotational center of a compressor drive shaft 18 as possible (installed remote from an inner wall face of the hermetically sealed vessel). By constituting such a discharge pipe structure, the refrigerant gas having a flow velocity as slow as possible is sucked from the opening portion of the discharge pipe 10.

Now, much of a mist-like refrigerant oil is included other than the refrigerant in gas compressed by a compression chamber of the compressor unit 2 and delivered from the refrigerant discharge port 3 installed at the compressor unit 2. For example, it is originally intended in the former of the above-described conventional technologies that when the mist-like gas delivered from the refrigerant discharge port and including much of the refrigerator oil passes the side of the motor unit, the refrigerator oil is separated sufficiently from the refrigerant gas by passing through the refrigerator passage installed at the stator, the refrigerator oil is stored at the oil storage portion of the lower portion of the hermetically sealed vessel and only the refrigerating gas is made to pass through the clearance between the stator and the rotor and is delivered from the discharge pipe installed between the compressor unit and the motor unit to the refrigerating cycle. Actually, owing to the large gap present at the coil end of the stator on the side of the compressor unit, the mist-like gas including much of the refrigerator oil leaks from the coil gap toward the rotor and is finally delivered to the refrigerating cycle.

Further, a shape of a balance weight of the rotor installed for correcting rotational unbalance of the compressor unit which is disposed at a vicinity of the discharge pipe to the refrigerating cycle is a horseshoe shape as shown by FIG. 3(*a*), by stirring the refrigerant in the upper space of the rotor, leakage from the above-described coil gap is increased and much of the refrigerator oil is included in the gas delivered to the refrigerating cycle.

Further, according to the latter of the above-described conventional technologies, the opening portion of the discharge pipe is disposed at the inner wall of the cylindrical drum and accordingly, owing to vortex flow caused by the rotor, the refrigerant gas in the compressor is delivered in a state in which the flow velocity is the largest and the refrigerator oil adhered to the inner wall of the cylindrical drum is delivered into the refrigerating cycle.

When an amount of the refrigerator oil delivered into the refrigerating cycle is increased, a rate of the refrigerant to gas circulating the refrigerating cycle is lowered and as a result, lowering of the heat exchange rate of the heat exchanger constituting the refrigerating cycle is resulted. Further, there poses a problem in which by reducing the refrigerator oil in the compressor, a dilution rate is increased and the like and sufficient oil feeding cannot be carried out to the bearing portion, the compression chamber or the like to thereby lower the reliability.

In order to resolve the problem, according to the embodiment, the discharge pipe 10 is installed between the compressor unit 2 and the motor unit 12, the opening portion of the discharge pipe 10 is installed as proximate to the rotational center of the shaft of the compressor as possible (the discharge pipe 10 is inserted deeply into the hermetically sealed vessel such that the opening portion of the discharge pipe 10 on the side of the hermetically sealed vessel is disposed at a portion in the hermetically sealed vessel inward from a position of an inner wall face of the hermetically sealed vessel inserted with the discharge pipe 10) and a ring 9 in a cylindrical shape made of an insulating material is installed at an outer periphery of a coil end 8 of a stator 6 on the side of the compressor unit. FIG. 2 schematically shows the coil end 8 and the stator 6. The cylindrical ring 9 for covering the coil end 8 is provided with a material the same as a material of an inter-phase insulating paper inserted among phases of a stator coil of a kind of plastics which is thin and excellent in insulation performance and fabrication performance. One sheet of a rectangular material slightly longer than an outer periphery of the coil end 8 is formed in a cylindrical shape to cover the outer periphery of the coil end 8 in respect of the diameter. An upper portion thereof is cut at several locations to cover also the upper portion of the coil end 8 and cut portions are folded inwardly and overlapped portions are cut off to eliminate them such that a total or a portion of a rotor 4 is exposed (a plurality of lines drawn in the radius direction at an upper portion of the ring 9 in FIG. 2). Further, the fabrication may be carried out by pressing. Further, almost all of the refrigerant which flows to the upper portion of the rotor 4 via the coil end 8 is disposed at a vicinity of a root of the coil end 8 and accordingly, an end portion of the coil end 8 (a portion having a small radius of curvature where lines of coil are folded) may not necessarily be covered. Further, although the ring 9 is installed at the outer periphery, a similar effect is achieved even when the ring 9 is installed at the inner periphery of the coil end 8 within a range of not effecting an influence on rotation of the rotor 4 by being brought into contact therewith (in this case, the discharge pipe 10 is inserted more deeply than a space between the outer periphery of the coil end 8 and the inner wall of the cylindrical drum).

Flow of the refrigerant is changed as follows by installing the ring 9 in the cylindrical shape at the outer periphery of the coil end 8 as shown by FIG. 2. The gas refrigerant including much of the refrigerator oil delivered from the discharge port 3 reaches the side of the motor unit 12 via the through holes 17 opened at the surrounding of the compressor unit 2. In the case of the conventional technology, the gas refrigerant flows from the gap of the coil end of the stator to a vicinity of a central upper portion of the rotor in a large amount and accordingly, even when the discharge pipe is inserted to a vicinity of the central portion, the refrigerant including much of the refrigerator oil flows out to the refrigerating cycle. According to the embodiment, the gas including much of the refrigerator oil which flows to the side of the motor unit 12, passes through an intermediary between an outer wall face of the ring 9 installed to cover the surrounding of the coil end 8 and an inner wall face of the cylindrical drum 1 of the hermetically sealed vessel and passes through the refrigerant passage 7 installed at the stator 6 to thereby sufficiently separate the refrigerator oil from the refrigerant gas. Thereafter, the refrigerant gas in which the flow velocity of vortex flow is slow and a content of the refrigerator oil is lowered, passes through the clearance between the stator 6 and the rotor 4 and flows to the upper space of the rotor 4. Further, the refrigerant gas is delivered to the refrigerating cycle by passing through the discharge pipe 10 which is inserted deeply to a vicinity of the space (inserted to span a space formed between the ring 9 and the inner wall of the cylindrical drum 1).

Thereby, as shown by FIG. 4, much of the mist-like refrigerator oil delivered from the discharge port 3 floats in the hermetically sealed vessel 1, an amount thereof discharged to the refrigerating cycle can be reduced and the refrigerator oil can be stored at the bottom portion of the hermetically sealed vessel.

In the meantime, according to the latter of the above-described conventional technologies, the refrigerant does not flow the passage reaching the space present between the thrust bearing and the rotor 4 by passing through the clearance between the rotor 4 and the stator 6 via the upper portion of the oil storage portion installed at the bottom portion of the hermetically sealed vessel by passing through the total periphery of the surrounding of the coil end 8 and the total periphery of an intermediary between the stator 6 and the inner wall of the cylindrical drum 1 as in the embodiment, but there is constituted the passage reaching the oil storage portion at the bottom portion of the vessel only via single ones of the flow guide plate and the oil separator installed between the coil end and the cylindrical drum and reaching the space between the block and the rotor from the oil storage portion via another one of the oil separator and the clearance between the rotor and the stator. Therefore, there poses a problem in which the pressure loss is significant and when it is integrated to the refrigerating cycle, the input becomes large and accordingly, the efficiency (coefficient of performance (COP)) of the refrigeration cycle is deteriorated. According to the embodiment, there is constituted the passage in which the refrigerant is guided from the total periphery of the surrounding of the coil end 8 to the bottom portion of the hermetically sealed vessel and the pressure loss is reduced than in passing the refrigerant through the single one of the flow guide plate according to the latter of the conventional technologies.

Further, according to the above-described conventional technologies, in sleep running (where a time period of stop to start is long, for example, one night), or the like when a large amount of the liquid refrigerant is sucked from the suction pipe, since the passage of flowing the refrigerant is narrow, the liquid refrigerant at high pressure is delivered from the discharge port toward the lower portion of the compressor and accordingly, refrigerator oil 11 stored at the lower portion of the compressor is foamed by the injected refrigerant and the foamed refrigerant including much of the refrigerator oil is present up to the upper space of the stator. At this occasion, the opening portion of the discharge pipe which is opened in the hermetically sealed vessel is substantially flush with the inner wall of the cylindrical drum and accordingly, vortex flow is produced in the refrigerant gas in the compressor by the rotor and the refrigerant gas is delivered from the vicinity of the inner wall of the cylindrical drum having the largest flow velocity. Accordingly, the above-described foamed refrigerant or the refrigerator oil mixed with the refrigerant produced by scraping off the refrigerator oil adhered to the inner wall of the cylindrical drum is delivered to the refrigerating cycle and the heat exchange rate is lowered.

According to the embodiment, as described above, the pressure loss is reduced and accordingly, the flow velocity of the refrigerant delivered to the lower portion of the hermetically sealed vessel is lowered and therefore, foaming is difficult to produce, further, the discharge pipe is deeply inserted and therefore, the refrigerator oil scraped off the inner wall of the cylinder is difficult to deliver from the discharge pipe 10.

Further, although according to the above-described conventional technologies, there poses a problem in which the refrigerator oil is liable to flow out into the refrigerating cycle and therefore, the refrigerator oil in the compressor is reduced and oil feeding to the bearing portion, the compressor unit or the like cannot be carried out sufficiently or the like, according to the embodiment, such a problem is not posed since the refrigerator oil can be prevented from flowing out to the refrigerating cycle.

The ring 9 mentioned above, can prevent the refrigerant gas including much of the refrigerator oil from leaking from the gap of the coil 8 of the stator 6 on the side of the compressor unit and delivering to the refrigerating cycle and an amount of the refrigerator oil discharged to the refrigerating cycle can be reduced. According to the embodiment, to achieve a further effect, the shape of the balance weight 5 is constituted such that the shape of the outer periphery is substantially circular (a cylindrical shape one portion of which is opened) and the end face is flat.

As shown by FIG. 1, the side of the compressor unit of the rotor 4 (upper portion of rotor 4) is disposed at the vicinity of the discharge pipe 10. As shown by FIG. 3(*b*), the shape of the balance weight 5 is substantially circular (cylindrical shape one portion of which is opened) and an end face thereof on the side of the compressor unit is made flat (shape of outer periphery thereof is substantially a cylinder a half of which is thickened and a half of which is thinned) by which stirring in the space at the vicinity of the discharge pipe 10 on the upper side of the rotor 4 is reduced by which the refrigerant oil in the discharge gas into the refrigerating cycle can be reduced.

Further, an opening portion 5*a* (a notch portion installed at a thin wall portion and a notch portion smaller than semicircular arc) is installed at a portion of the balance weight and accordingly, by discharging the refrigerator oil which flows from a clearance 14 of the bearing portion to the upper portion of the rotor 4 to the lower portion of the compressor, the refrigerator oil in the discharge gas produced by the stirring operation of the rotor 4 can be reduced. That is, the refrigerator oil stored at the inner portion flows to the thin wall portion by centrifugal force and accordingly, the refrigerator oil can be discharged by the centrifugal force since the opening portion 5a is installed at the thin wall portion.

In this way, an amount of the refrigerator oil discharged to the refrigerating cycle can be reduced, as a result, the heat exchange rate can be prevented from lowering, further, there can be provided the sealed compressor driven by a motor having the high reliability capable of sufficiently feeding oil to the bearing portion, the compression chamber or the like.

According to the present invention, flowing of the refrigerator oil from the discharge pipe can be reduced while restraining the pressure loss of the compressor. Further, stirring of fluid in the hermetically sealed vessel of the compressor by the balance weight can be reduced.

What is claimed is:

1. A sealed compressor comprising:

a hermetically sealed vessel;

a compressor unit provided in the hermetically sealed vessel to compress refrigerant;

a motor unit provided in the hermetically sealed vessel connected to the compressor unit, the motor unit having a rotor and a stator; and a ring installed on the stator and covering a coil end of the stator on a side of the compressor unit.

2. A sealed compressor, comprising:

a hermetically sealed vessel;

a compressor unit provided in the hermetically sealed vessel to compress refrigerant;

a motor unit provided in the hermetically sealed vessel connected to the compressor unit, the motor unit having a rotor and a stator; and a balance weight installed at an end portion of the rotor on a side of the compressor unit, the balance weight having a substantially cylindrical outer periphery and having a notch at a portion of the outer periphery on the compressor side, the notch portion extending over an arc of the outer periphery smaller than a semicircular arc.

3. The sealed compressor according to claim 1, further comprising:

a discharge pipe inserted into the hermetically sealed vessel, the pipe being located between the compressor unit and the motor unit, an opening of the discharge pipe being located inwardly of an inner wall of the hermetically sealed vessel and being inserted more deeply than at least an outer periphery of the coil end covered by the ring.

4. The sealed compressor according to claim 1, further comprising:

a passage for leading the refrigerant from a space between the compressor unit and the motor unit to a bottom portion of the hermetically sealed vessel, the passage comprising an entire periphery of a space between the outer periphery of the stator and an inner periphery of the sealed vessel.

5. The sealed compressor according to claim 1, wherein the ring completely surrounds an outer periphery of the coil end.

6. The sealed compressor according to claim 1, wherein the ring surrounds an inner periphery of the coil end.

7. The sealed compressor according to claim 2, wherein the balance weight has a flat upper surface.

8. The sealed compressor according to claim 2, further comprising:

a discharge pipe inserted into the hermetically sealed vessel, the pipe being located between the compressor unit and the motor unit, and opening of the discharge pipe being inserted inwardly of an inner wall of the hermetically sealed vessel and being located in a spade on the upper side of the rotor.

9. A sealed compressor, comprising:

a hermetically sealed vessel;

a compressor unit provided in the hermetically sealed vessel to compress refrigerant;

a motor unit provided in the hermetically sealed vessel connected to the compressor unit, the motor unit having a rotor and a stator; and a ring installed on the stator and covering a coil end of the stator on a side of the compressor unit; and a balance weight installed at an end portion of the rotor on a side of the compressor unit, the balance weight having a substantially cylindrical outer periphery and having a notch at a portion of the outer periphery on the compressor side, the notch portion extending over an arc of the outer periphery smaller than a semicircular arc.

10. The sealed compressor according to claim 9, further comprising:

a discharge pipe inserted into the hermetically sealed vessel, the pipe being located between the compressor unit and the motor unit, an opening of the discharge pipe being located inwardly of at least an outer periphery of the coil end covered by the ring.

11. The sealed compressor according to claim 9, further comprising:

a passage for leading the refrigerant from a space between the compressor unit and the motor unit to a bottom portion of the hermetically sealed vessel, the passage comprising an entire periphery of a space between the outer periphery of the stator and an inner periphery of the sealed vessel.

12. The sealed compressor according to claim 9, wherein a wall of the balance weight on the compressor side has a thick portion and a thin portion, the thin portion creating a space in an inner periphery of the balance weight, the notch being provided in the thin portion.

13. The sealed compressor according to claim 2, wherein a wall of the balance weight on the compressor side has a thick portion and a thin portion, the thin portion creating a space in an inner periphery of the balance weight, the notch being provided in the thin portion.

* * * * *